United States Patent [19]

Deardorff et al.

[11] 4,213,571

[45] Jul. 22, 1980

[54] DUST SYSTEM FOR A GRINDER-MIXER

[75] Inventors: Duane R. Deardorff, Ephrata; William W. Mann, Leola, both of Pa.

[73] Assignee: Sperry Corporation, New Holland, Pa.

[21] Appl. No.: 26,261

[22] Filed: Apr. 2, 1979

[51] Int. Cl.[3] ..... B02C 13/288

[52] U.S. Cl. ..... 241/48; 241/56; 241/101 B

[58] Field of Search ..... 366/603; 241/101.7, 241/101 B, 56, 189 R, 186.1, 186 R, 81, 97, 79.1, 80

[56] References Cited

U.S. PATENT DOCUMENTS 3,840,189 10/1974 Kanengieter et al. ..... 241/101 B X

*Primary Examiner*—Mark Rosenbaum

*Attorney, Agent, or Firm*—Ralph D'Alessandro; Frank A. Seemar; Larry W. Miller

[57] ABSTRACT

In a grinder-mixer apparatus there is provided an improved dust collection system which draws off air and suspended finely ground crop particle materials from the front side of the hammermill, transfers it to a cyclone separator where the particulate matter is separated out and fed back into the top of the hammermill for further grinding and ultimate delivery to the mixing tank.

13 Claims, 1 Drawing Figure

DUST SYSTEM FOR A GRINDER-MIXER

BACKGROUND OF THE INVENTION

The present invention relates generally to an agricultural grinder-mixer and more specifically to an improved dust collection system for removing the finely ground crop material suspended in the air from the hammermill area, separating this material within the dust collector thereby allowing the material to settle out, directing the settled out material back into the top of the hammermill and then transferring it into the hammermill discharge auger for delivery into the mixing tank.

Grinder-mixers of the type commonly utilized today employ various dust collection systems to draw off the finely ground crop material particles that are suspended in the air from the area of the hammermill and cycle them through what is normally a centrifugal cyclone separator to centrifugally separate out the dust particles from the air. This technique permits the recovery of additional crop material which is then recycled down into the hammermill discharge auger or some type of transport means for delivery into the mixing tank. Numerous dust collection systems have been designed for this purpose with varying degrees of success. Regardless of the different designs that exist for agricultural grinder-mixer dust collection systems, all employ some sort of a suctioning device, such as a fan, to draw off the finely ground crop particles suspended in the air from an area generally adjacent the hammermill. The suctioning device or fan creates sufficient air flow to transport the suspended material to a particular collection and separating means.

The location of the fan in the dust collection system has even been the basis for variations in design approaches. Some designs have positioned a fan on the front side of the hammermill attached to the hammermill housing to minimize the amount of ground particles that are drawn off from the grain flow as it is transported rearwardly from the hammermill by the discharge auger into the mixing tank. This particular design arrangement ensures that primarily only the finely ground crop material particles of particular matter suspended in the air surrounding the hammermill are drawn off since the heavier less finely ground particles are conveyed rearwardly out of the back of the hammermill housing towards the mixing tank by the discharge auger. This placement of the fan is an improvement over those grinder-mixers which draw off the particulate crop material from the rear side of the hammermill. These latter grinder-mixers are much more likely to include in the air stream greater amounts of the less finely ground particles, even including portions of corn cobs, which are in the grain material flow being transported out the rear of the housing towards the mixing tank.

Other grinder-mixer designs employ dust collection systems which return the settled out particulate crop material from the cyclone separator back into the hammermill discharge or unloading auger intermediately of the hammermill and the mixing tank. This type of design, especially in grinder-mixers employing an air draw system from the rear of the hammermill, suffers from the disadvantage of tending to plug or clog the hammermill discharge auger at the point where the return chute feeds into the auger since a relatively large volume of crop material can be deposited into the discharge auger at that point. When the settled out crop material is added to the ground crop material flow already being transferred by the unloading auger, the auger quite frequently will become overloaded and plugging will occur, especially when the particulate matter being returned is interspersed with large clumps of crop material, such as corn cobs. An additional disadvantage of this type of a design for a dust collection system readily becomes apparent whenever an abundance of ground crop material accumulates in the bottom of the hammermill adjacent the discharge outlet above the discharge auger. Such a buildup of material plugs the hammermill and lowers its efficiency by decreasing the amount of crop material and air that can flow out of the discharge outlet. When this plugging occurs, a dust collection system of this design is in effect short circuited since the fan draws air directly from the discharge chute or duct of the separator, through the unloading auger, past the fan and into the separator. Since little or no air can pass through the hammermill due to the plugging, the air flow continues in a continuous loop never drawing air from the hammermill area with its suspended particulate matter.

Another design found on grinder-mixers utilizes a dust collection system that draws off the finely ground grain material that is suspended in the air from a chamber that is positioned atop an opening in the hammermill discharge auger. This design suffers the same basic disadvantage of tending to draw off the larger and generally heavier crop material, such as kernels of grain and portions of corn cobs, that already has been through the hammermill and is being transferred in the hammermill unloading auger to the mixing tank.

Still another variation in design draws the air from the hammermill housing, cycles it up into the dust collector and then returns the settled crop material back into the hammermill on the rear side of the housing adjacent the fan. This type of a system will not only maximize the amount of ground crop material that is drawn off by the suction of the fan into the air stream directed to the cyclone separator, but also causes the settled out crop material to cause excessive and uneven wear on the hammers of the hammermill by concentrating the returned material's entry on one edge of the hammermill.

One further grinder-mixer design in this area discharges the settled out particulate matter from the separator back into the infeed hopper of the hammermill. This type of a system tends to promote plugging in the separator outlet since the material being fed into the hammermill for grinding prevents the particulate matter from easily discharging from the separator outlet.

Additionally, the grinding of crop materials in a hammermill naturally generates some heat as the kinetic energy used to drive the hammermill is converted partially into thermal energy. This heat is generally retained in the ground crop material particles and transferred with them into the mixing tank. Traditional grinder-mixers employ grinding and dust collection systems that generally tend to promote the buildup of this heat in the crop material, especially when plugging occurs. When the grinder-mixer is left outside overnight, the heat that is retained within the mixing tank produces condensation on the inside of the tank when the outside air temperature naturally drops. This condensation will cause any crop material in the tank to sour, especially in the case of crops such as barley and oats. This causes the feed mixture to be less palatable and it usually is shunned by the livestock for whom it is intended. This can result in considerable quantities of feed mixture being wasted.

The foregoing problems are solved in the design of the apparatus comprising the present invention by providing for an improved dust collection system having a fan that is mounted on the front side of the grinding means and returns the settled out crop material from the cyclone separator to the top of the hammermill housing where it is distributed equally across the entire length of the hammermill.

SUMMARY OF THE INVENTION

It is an object of the present invention to provide in a grinder-mixer apparatus an improved dust collection system that will draw off the finely ground crop material particles suspended in the air surrounding the hammermill, direct the particles in a cyclone separator, settle the particulate matter out of the air and direct it back into the hammermill at a location that enchances the overall operating efficiency of the machine and increases the quantity of ground crop material that is transferred to the mixing apparatus.

It is a feature of the present invention to provide an improved dust collector system that draws the suspended finely ground crop material particles from the air surrounding the hammermill out of the front side of the hammermill housing and recycles the settled particulate matter back into the top of the hammermill for ultimate transfer into the mixing tank.

It is an advantage of this invention that the hammermill discharge auger transferring the ground crop material into the mixing tank does not plug with material in the discharge area as particulate material which is settled out of the air discharges into the top of the hammermill instead of the discharge auger.

It is another advantage of the present invention that there is minimal dust omission from the top of the entire dust collection system because of the suction created by the hammermill rotor as it turns within the specific design employed in this system.

It is a further advantage of the instant invention that plugging of the dust collector is prevented by having the settled particular matter reenter the hammermill from the top and not via the hammermill infeed hopper.

It is another advantage of this invention that less wear occurs on the hammermill hammers and better distribution of crop material is achieved across the entire hammermill by having the settled out particulate matter reenter the hammermill from the top where even distribution is achieved across and through the entire length of the hammermill rather than having the particulate matter reenter from the side of the hammermill.

It is an additional advantage of the present invention that the design of the dust collection system promotes the drawing of ground crop material out of the hammermill area into the hammermill discharge auger, thereby reducing hammermill plugging and permitting the flow of air through the system in a manner that prevents the air flow from bypassing the hammermill area.

It is another advantage of this invention that the dust collection system is a simple design requiring relatively few parts and, therefore, results in a low production cost.

These and other objects, features and advantages are obtained by providing in a grinder-mixer apparatus an improved dust collection system which draws off air and suspended finely ground crop material particles from the front side of the hammermill, transfers it to a cyclone separator where the particulate matter is separated out and fed back into the top of the hammermill for further grinding and ultimate delivery to the mixing tank.

BRIEF DESCRIPTION OF THE DRAWING

The advantages of this invention will become apparent upon consideration of the following detailed disclosure of the invention, especially when it is taken in conjunction with the drawing, wherein.

DETAILED DESCRIPTION OF THE PREFERRED EMBODIMENT

Figure 1:
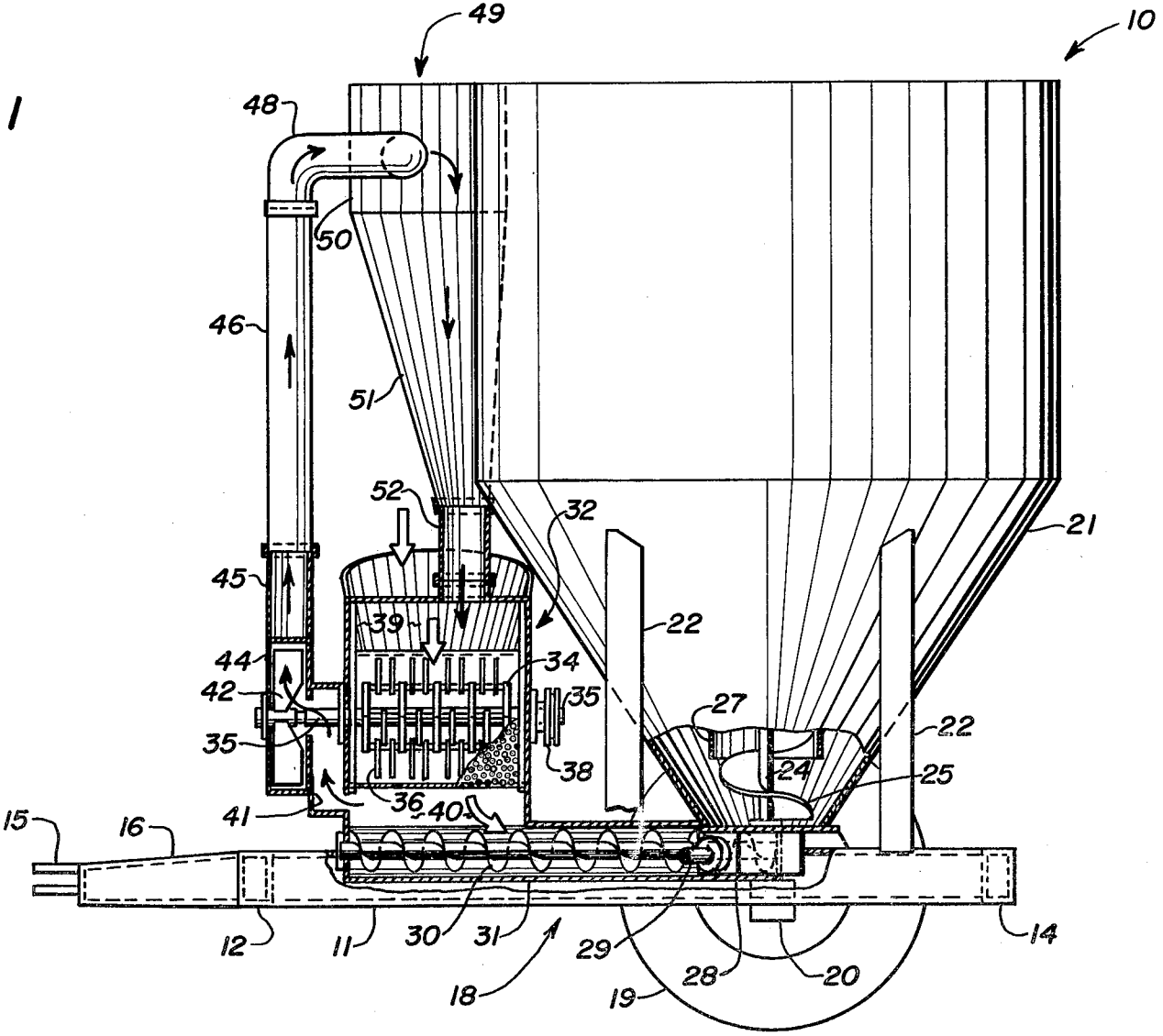
FIG. 1 is a side elevational view of a grinder-mixing apparatus adapted to be fastened to and powered by a tractor illustrating in partially diagrammatical and partially cut away detail the improved dust collection system.

Referring to FIG. 1, there is shown a general representation of a grinder-mixing apparatus 10 adapted to be fastened to a tractor which provides not only the motive power to transport the apparatus from one location to another, but also serves as the power source for the rotary driven components of the grinder-mixer apparatus 10. The grinder-mixer 10 comprises a frame having parallel side frame members 11 connected to a front cross support member 12 and a rear cross support member 14. Connected to the front cross support member 12 by converging hitch members 16 is a towing hitch 15 which is adapted to be suitably fastened to the tractor. A power takeoff shaft (not shown) connects to the power takeoff driving shaft of the tractor to drive the rotary components of the grinder-mixer 10. These structural members comprise a lower frame, indicated generally by the numeral 18, which supports the main grinding and mixing components. The lower frame 18 is mobilely supported by a pair of wheels 19 (only one of which is shown) mounted to axle and support beam 20.

The lower frame 18 has suitably mounted thereon a mixing tank 21 which is braced by tank supports 22 connected to the tank 21 and the frame members of the lower frame. The tank 21 has an internally supported, substantially upright shaft 24 extending upwardly from the bottom of the tank toward the top. The shaft 24 has a vertical auger 25 with flighting spirally mounted about the shaft. A short distance above the base of the mixing tank 21 vertical auger 25 has a generally cylindrically shaped vertical auger housing 27 which surrounds the auger 25 and extends generally upwardly toward the top of the tank 21. The auger 25 is driven conventionally from the power takeoff shaft (not shown) that is connected to the tractor. Power is transferred to a partially illustrated input drive shaft 29 at the base of the tank 21. A driving gearbox 28 transfers the power from the input shaft 29 to the auger 25.

Forwardly of the mixing tank 21 and suitably mounted atop the lower frame 18 of the hammermill 34. Hammermill 34 is encased with a housing, indicated generally by the numeral 32. The hammermill 34 is of a conventional type and has a plurality of rotating hammer elements 36 mounted about a series of shafts attached to main hammermill rotor shaft 35. Shaft 35 extends through the entire length of the hammermill housing 32 and at its rearmost end has sheave 38 fastened thereto. Sheave 38 is connected via a belt (not shown) to the previously mentioned power takeoff shaft to provide the transfer of rotary power to the hammermill 34. The hammermill housing 32 further has an infeed hopper area, indicated by the numeral 39, where crop material is directed into one side of a hammermill and then downwardly onto the rotating hammermill. The ground crop material is then discharged from the hammermill area through the housing outlet area 40 into a hammermill discharge auger 30 that is positioned within an auger trough 31. Individual arcuately shaped screens (not shown), each having differently sized apertures therein, can be inserted in the outlet area 40 beneath the hammermill 34 and above the discharge auger 30. These screens serve to more finely size the crop material after it has been ground in the hammermill by having the material pass therethrough from the combined effect of the suctioning force of the air flow created by the fan 42 and the pressure of crop material being directed downwardly thereagainst by the rotating hammermill 34. Generally only one screen at a time is used. The discharge auger 30 ultimately feeds into the mixing tank 21.

The dust collection system includes a fan 42 mounted about the forward portion of shaft 35. Fan 42 draws air out of a draw chamber 41 adjacent the hammermill and directs air and crop material suspended in the air adjacent the hammermill upwardly in an air stream through fan outlet duct 45. Housing 44 surrounds the fan 42 and facilitates the passing of crop material in the air stream upwardly into the outlet duct 45. Air duct 46 connects to the outlet duct 45 on its lowermost end and to elbow infeed duct 48 at its uppermost end. Duct 48 is then joined to a conventional cyclone separator and dust collector 49. The separator and dust collector 49 has an infeed housing 50 and a settling duct 51 which serves to close the air flow loop to the hammermill infeed duct 52. Hammermill infeed duct 52 is mounted on the top of the hammermill housing opposite the infeed hopper area 39. Thus a continuous loop of air flows from the hammermill draw chamber 41 to the fan 42, into the dust collector and cyclone separator 49 and back into the hammermill housing 32.

The grinder-mixer is not described in any further detail at this time since the structure is old and generally well known to one of skill in the art. The detailed structure is shown in greater detail in U.S. Pat. No. 3,638,816, herein specifically incorporated by reference.

In operation, the grinder-mixer has crop material fed into the feed hopper 39 of the hammermill 34. Crop material passes down into contact with the hammermill 34 and its rotating hammer elements 36, where it is ground into fine particles. The crop material particles are then discharged through a screen at the bottom of the hammermill housing outlet area 40 into the auger trough 31 where it is carried rearwardly by the discharge auger 30 to the mixing tank 21. The crop material enters the bottom of the mixing tank 21 and is transported by the vertical auger 25 upwardly in the conventional manner to obtain a well mixed feed mixture. Crop material particles suspended in the air adjacent the hammermill are drawn off through a draw chamber 41 by the suction force of fan 42. Fan 42 imparts sufficient force to the air to generate an air flow that passes upwardly through fan outlet duct 45, air duct 46 and elbow infeed duct 48 to deliver the crop material to the cyclone separator and dust collector 49. At this point the air flow, with its suspended particulate matter, is passed into the infeed housing 50 where the cyclone separator settles out the particulate crop material. The crop material then is directed downwardly through settling duct 51 into infeed duct 52. Infeed duct 52 is positioned generally centrally and atop the hammermill housing 32 to direct the settled out crop material back into the hammermill through which it can pass into the auger trough for ultimate transfer to the mixing tank.

While the preferred structure in which the principles of the present invention have been incorporated is shown and described above, it is to be understood that the invention is not limited to the particular details thus presented, but, in fact, widely different means may be employed in the practice of the broader aspects of this invention. The scope of the appended claims is intended to encompass all obvious changes in the details, materials and arrangements of parts which will occur to one of ordinary skill in the art upon a reading of this disclosure.

Having thus described the invention, what is claimed is:

1. In a grinding and mixing apparatus having a mixing container and mixing means mounted therein, grinding means having a top, a first side and an opposing second side, and a dust collector, the improvement comprising:

improved dust collection means having a fan mounted to the first side of the grinding means for generating an air flow and therewith removing finely ground material from the area of the grinding means and transferring it to the dust collector where the material is separated out and fed back into the top of the grinding means in a generally downward vertical path for grinding prior to being delivered to the mixing container.

2. The grinding and mixing apparatus according to claim 1 wherein the dust collector further comprises separating means for centrifugally separating material from the air flow.

3. The grinding and mixing apparatus according to claim 2 wherein the grinding means further includes a hammermill rotatable about a central shaft, the hammermill further having a plurality of rotating hammer elements.

4. The grinding and mixing apparatus according to claim 3 wherein the mixing container comprises an elongate tank having a generally cylindrical upper portion and a conically shaped lower portion.

5. The grinding and mixing apparatus according to claim 4 wherein the mixng means comprises a generally vertical auger positioned centrally within the tank and being partially supported thereby.

6. The grinding and mixing apparatus according to claim 1 wherein the first side of the grinding means is positioned farther from the mixing container than is the opposing second side.

7. In a grinding and mixing apparatus having a mixing container with mixing means movably mounted therein, grinding means having a top, a first side, an opposing second side, an infeed area and a discharge outlet area and a dust collector connected to the top of the grinding means, the improvement comprising:

improved dust collection means having (a) air flow generating means mounted to the first side for generating a flow of air that moves in a predetermined path of travel, the generating means further being connected to the discharge outlet area so that air and particulate matter suspended therein may freely move in the air flow from the discharge outlet area to the generating means; and (b) ducting means having a first and a second end, the first end being connected to the generating means and the second end to the dust collector so that the air flow is drawn from the discharge outlet area and is directed by the generating means through the ducting means to the dust collector and then into the top of grinding means to thereby form a closed path of travel wherein particular matter suspended in the air adjacent the grinding means is carried in the air flow to the dust collector where it is separated out and fed into the top of the grinding means in a generally downward vertical path for grinding prior to being delivered to the mixing container.

8. The grinding and mixing apparatus according to claim 7 wherein the dust collector further comprises separating means for centrifugally separating material from the air flow.

9. The grinding and mixing apparatus according to claim 8 wherein the grinding means further includes a hammermill rotatable about a central shaft, the hammermill further having a plurality of rotating hammer elements.

10. The grinding and mixing apparatus according to claim 9 wherein the mixing container comprises an elongate tank having a generally cylindrical upper portion and a conically shaped lower portion.

11. The grinding and mixing apparatus according to claim 10 wherein the mixing means comprises a generally vertical auger positioned centrally within the tank and being partially supported thereby.

12. The grinding and mixing apparatus according to claim 7 wherein the first side of the grinding means is located at a distance farther away from the mixing container than is the opposing second side.

13. In a grinding and mixing apparatus having a mixing container and mixing means mounted therein, grinding means adjacent the mixing container and in material flow communication therewith, the grinding means further having a top, a back side closest to the mixing container and an opposing front side farthest from the mixing container with outlet means attached thereto, and a dust collector, the improvement comprising:

an improved dust collection system having a fan mounted to the front side of the grinding means for generating an air flow and therewith removing finely ground material from the area of the grinding means and transferring it to the dust collector where the material is separated out and fed back into the top of the grinding means in a generally downward vertical path for grinding prior to being delivered to the mixing container.

* * * * *